US007363770B2

(12) United States Patent
Hong et al.

(10) Patent No.: US 7,363,770 B2
(45) Date of Patent: Apr. 29, 2008

(54) AIR CONDITIONER

(75) Inventors: Ki Su Hong, Anyang-si (KR); Jung Woo Lee, Seoul (KR); Seong Won Bae, Seoul (KR); Sim Won Chin, Seoul (KR)

(73) Assignee: LG Electronics Inc., Seoul (KR)

( * ) Notice: Subject to any disclaimer, the term of this patent is extended or adjusted under 35 U.S.C. 154(b) by 265 days.

(21) Appl. No.: 11/342,798

(22) Filed: Jan. 31, 2006

(65) Prior Publication Data

US 2006/0213212 A1 Sep. 28, 2006

(30) Foreign Application Priority Data

Mar. 22, 2005 (KR) ..... 10-2005-0023669

(51) Int. Cl.
*F25D 23/00* (2006.01)
*F28D 5/00* (2006.01)

(52) U.S. Cl. ..... 62/271; 62/304

(58) Field of Classification Search ..... 62/93, 62/94, 271, 304, 314, 332, 410, 412, 176.1; 55/268; 95/113; 96/125
See application file for complete search history.

(56) References Cited

U.S. PATENT DOCUMENTS

| | | | | |
|---|---|---|---|---|
| 5,170,633 | A * | 12/1992 | Kaplan | 62/94 |
| 5,460,004 | A * | 10/1995 | Tsimerman | 62/94 |
| 6,050,100 | A * | 4/2000 | Belding et al. | 62/271 |
| 6,199,394 | B1 * | 3/2001 | Maeda | 62/271 |
| 6,318,106 | B1 * | 11/2001 | Maeda | 62/271 |
| 6,321,546 | B1 * | 11/2001 | Johnson et al. | 62/173 |
| 6,497,107 | B2 * | 12/2002 | Maisotsenko et al. | 62/121 |
| 7,007,495 | B2 * | 3/2006 | Lee et al. | 62/271 |
| 7,104,077 | B2 * | 9/2006 | Yabu et al. | 62/94 |
| 7,260,945 | B2 * | 8/2007 | Landry | 62/94 |
| 2005/0257535 | A1 | 11/2005 | Jung et al. | |
| 2005/0257688 | A1 | 11/2005 | Bae et al. | |

FOREIGN PATENT DOCUMENTS

| | | |
|---|---|---|
| JP | 11-101473 | 4/1999 |
| JP | 2002-039570 | 2/2002 |
| JP | 2002-066251 | 3/2002 |
| JP | 2002-089905 | 3/2002 |
| JP | 2002-195606 | 7/2002 |
| WO | WO 96/41107 | * 12/1996 |

OTHER PUBLICATIONS

English Language Abstract of JP 2002-195606.
English Language Abstract of JP 11-101473.
English Language Abstract of JP 2002-066251.
English Language Abstract of JP 2002-089905.
English Language Abstract of JP 2002-039570.

* cited by examiner

*Primary Examiner*—Mohammad M. Ali
(74) *Attorney, Agent, or Firm*—Greenblum & Bernstein, P.L.C.

(57) ABSTRACT

An air conditioner is disclosed which includes a damper adapted to select a desired path of air humidified by a moisture release portion of a desiccant wheel in accordance with a humidification or dehumidification mode. In accordance with operation of the damper, humidified air is heat-exchanged in a heat exchanger in the dehumidification mode, so that the air is dehumidified. The dehumidified air is discharged into a room. In the humidification mode, the humidified air is directly discharged to the room. Thus, the air conditioner can be used as a humidifier or dehumidifier in accordance with a user selection.

20 Claims, 3 Drawing Sheets

AIR CONDITIONER

BACKGROUND OF THE INVENTION

1. Field of the Invention

The present invention relates to an air conditioner, and, more particularly, to an air conditioner which can be used in either humidification mode or dehumidification mode in accordance with a user selection, and in which there is no limitation to the installation place of the air conditioner when the air conditioner operates in the dehumidification mode.

2. Description of the Related Art

Generally, air conditioners are used to form more comfortable indoor environments for users. Such an air conditioner includes a dehumidifier for dehumidifying a confined space, for example, a room, a humidifier for humidifying the room, and a ventilator for ventilating the room.

FIG. 1 is a schematic view illustrating a configuration of a conventional dehumidifier.

As shown in FIG. 1, the conventional dehumidifier includes a first flow path 2, through which indoor air passes, a first blower 4 arranged in the first flow path 2, to force the indoor air to flow along the first flow path 2, a second flow path 6, through which outdoor air passes, and a second blower 8 arranged in the second flow path 6, to force the outdoor air to flow along the second flow path 6. The dehumidifier also includes a desiccant wheel 10 arranged such that the first and second flow paths 2 and 6 extend through the desiccant wheel 10, a rotator (not shown) which turns the desiccant wheel 10, a heater 16 arranged in the second flow path 6, to heat the outdoor air or desiccant wheel 10, and a heat exchanger 18 arranged in the second flow path 6, to condense moisture absorbed from the outdoor air by the desiccant wheel 10.

The desiccant wheel 10 includes two portions, namely, a moisture absorption portion 12 arranged in the first flow path 2, to absorb moisture from the indoor air, and a moisture release portion 14 arranged in the second flow path 6, to release moisture to the outdoor air. After being used for a predetermined time, the desiccant wheel 10 is turned by the rotator (not shown) such that the positions of the moisture absorption portion 12 and moisture release portion 14 are reversed.

In order to achieve an enhancement in heat exchange efficiency, the dehumidifier may include at least one heat exchanger 18. In the illustrated case, two heat exchangers 18 are sequentially arranged in a flow direction of the outdoor air in the second flow path 6. A drain pan 20 is arranged beneath the heat exchangers 18, to collect condensed water discharged from the heat exchangers 18.

Operation of the conventional dehumidifier having the above-mentioned configuration will now be described.

Indoor air introduced from a room into the dehumidifier along the first flow path 2 passes through the moisture absorption portion 12 of the desiccant wheel 10.

The moisture absorption portion 12 absorbs moisture from the indoor air, so that the indoor air is dehumidified. The dehumidified indoor air is re-discharged into the room.

Meanwhile, outdoor air introduced into the dehumidifier along the second flow path 6 is heated by the heater 16, and then passes through the moisture release portion 13 of the desiccant wheel 10.

At this time, the heated outdoor air dries the moisture release portion 14 of the desiccant wheel 10. That is, the moisture release portion 14 releases moisture to the outdoor air, so that the outdoor air absorbs the moisture from the moisture release portion 14.

The outdoor air, which has absorbed moisture from the moisture release portion 14 of the desiccant wheel 10, is introduced into the heat exchangers 18. As the introduced outdoor air heat-exchanges with the outdoor air passing around the heat exchangers 18, the moisture of the hot and moist outdoor air is condensed in the heat exchanger 18 by the indoor air which is cold.

Water produced in accordance with the condensation of the moisture from the outdoor air in the heat exchangers 18 is discharged into the drain pan 20.

However, since the conventional dehumidifier is configured only to dehumidify indoor air, it is in capable of humidifying indoor air.

Meanwhile, in an air conditioner which is switchable between dehumidification mode and humidification mode, a duct (not shown) connecting the air conditioner to both the indoors and the outdoors must be used. For this reason, there is a limitation to the installation place of the air conditioner. Furthermore, it is necessary to provide a separate path selector (not shown) at the duct (not shown), in order to selectively supply the humidified or dehumidified air to the indoors or outdoors. For this reason, there are problems of an increase in the size of the air conditioner, and a difficulty to prevent air leakage from occurring in the path selector (not shown).

SUMMARY OF THE INVENTION

The present invention has been made in view of the problems incurred in the related art, and it is an object of the invention to provide an air conditioner which is switchable between humidification mode and dehumidification mode in accordance with a user selection.

In accordance with the present invention, this object is accomplished by providing an air conditioner comprising: a desiccant wheel divided into a moisture absorption portion which absorbs moisture from air, and a moisture release portion which releases moisture to air; a first flow path which extends through the moisture absorption portion, to enable indoor or outdoor air passing through the first flow path to be dehumidified by the moisture absorption portion; a second flow path which extends through the moisture release portion, to enable indoor air passing through the second flow path to be humidified by the moisture release portion; a heat exchanger which heat-exchanges the air passing through the first flow path with the air humidified in the second flow path; a third flow path branched from the second flow path, to guide the air humidified in the second flow path to be discharged into a room after passing through the heat exchanger in a dehumidification mode; a fourth flow path branched from the second flow path, to guide the air humidified in the second flow path to be directly discharged into the room in a humidification mode; and a path selector adapted to select one of the third flow path and the fourth flow path, through which the air humidified in the second flow path will pass, when an associated one of the humidification mode and the dehumidification mode is selected.

The path selector may be arranged at a region where the third flow path and the fourth flow path are branched from the second flow path.

The path selector may comprise a damper adapted to selectively open one of the third flow path and the fourth flow path.

The path selector may comprise a 3-way valve adapted to selectively open one of the third flow path and the fourth flow path.

The branching of the third and fourth flow paths from the second flow path may be achieved inside the heat exchanger.

The heat exchanger may have an inlet which communicates with the second flow path, a first outlet which communicates with the third flow path, and a second outlet which communicates with the fourth flow path.

The air conditioner may further comprise an operating panel which enables a user to select one of the dehumidification mode and the humidification mode, and a controller which controls the path selector in accordance with an operation of the operating panel.

The air conditioner may further comprise a heater arranged in the second flow path, to heat the air passing through the moisture releasing portion.

The air conditioner may further comprise a drain pan adapted to collect condensed water discharged from the heat exchanger.

The drain pan may be detachably mounted in the air conditioner beneath the heat exchanger.

Since the air conditioner according to the present invention includes the path selector to select a desired flow path of air humidified in the moisture release portion of the desiccant wheel in accordance with the humidification mode or dehumidification mode, the air conditioner can be usable as either a humidifier or a dehumidifier, in accordance with a user selection.

Also, since only indoor air is used when the air conditioner operates in the dehumidification mode, the first flow path is separable from the outdoor ducts. In this case, accordingly, there is an advantage in that the air conditioner can be installed in any place in the room.

BRIEF DESCRIPTION OF THE DRAWINGS

The above objects, and other features and advantages of the present invention will become more apparent after reading the following detailed description when taken in conjunction with the drawings, in which.

DESCRIPTION OF THE PREFERRED EMBODIMENTS

Hereinafter, exemplary embodiments of an air conditioner according to the present invention will be described with reference to the annexed drawings.

Figure 1:
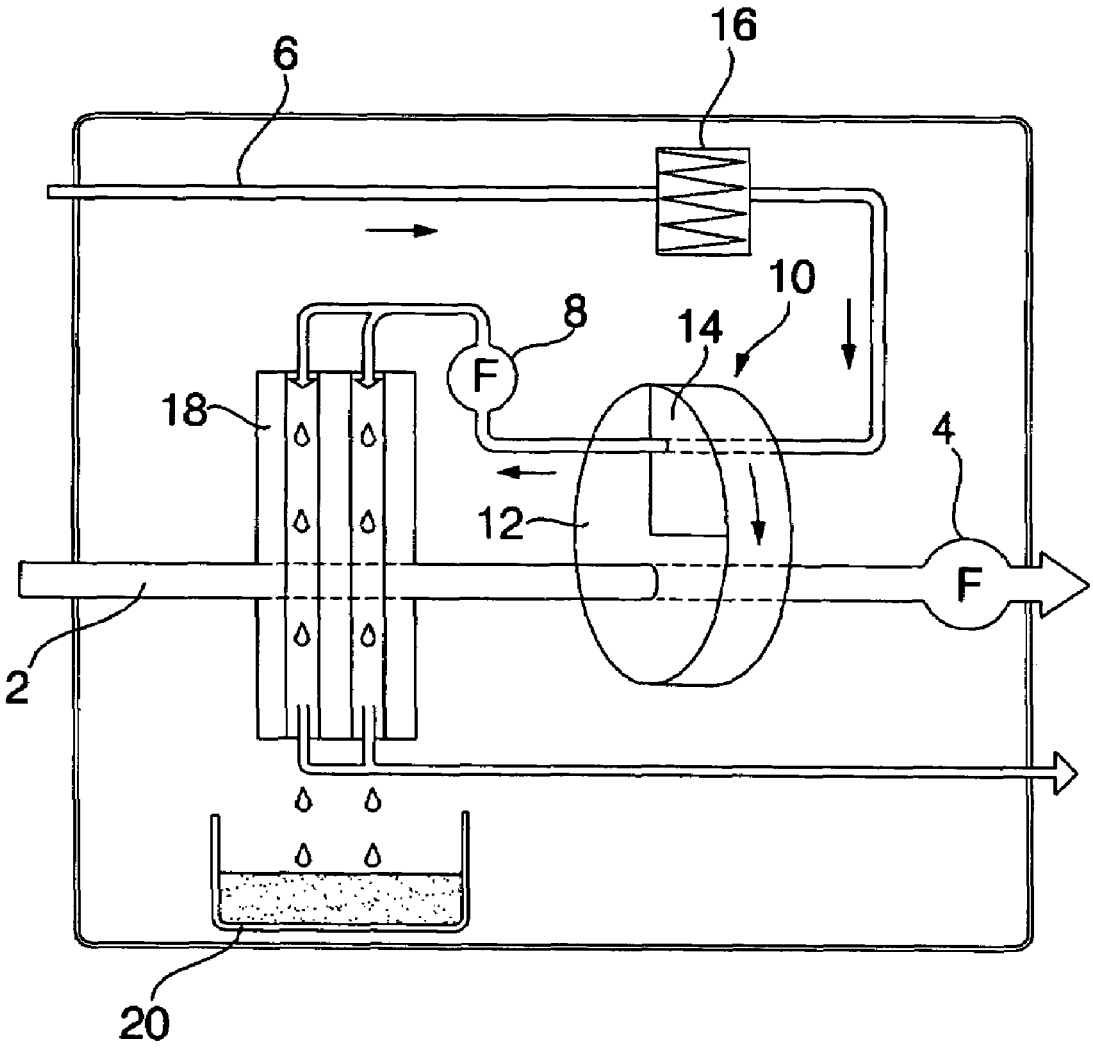
FIG. 1 (Prior Art)
FIG. 1 is a schematic view illustrating a configuration of a conventional dehumidifier.
Figure 2:
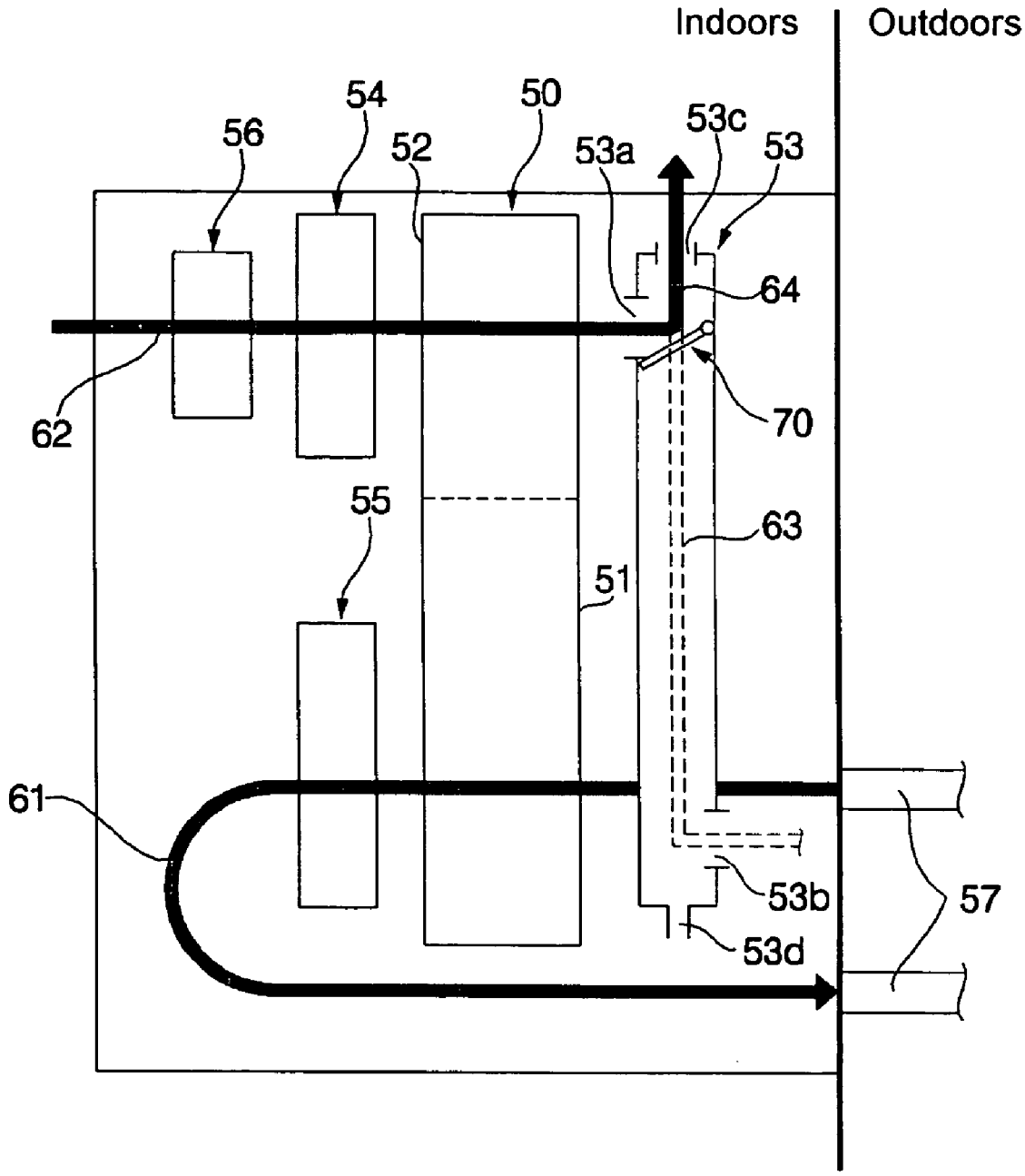
FIG. 2 is a schematic view of an air conditioner according to an exemplary embodiment of the present invention, illustrating a state in which the air conditioner operates in humidification mode.
Figure 3:
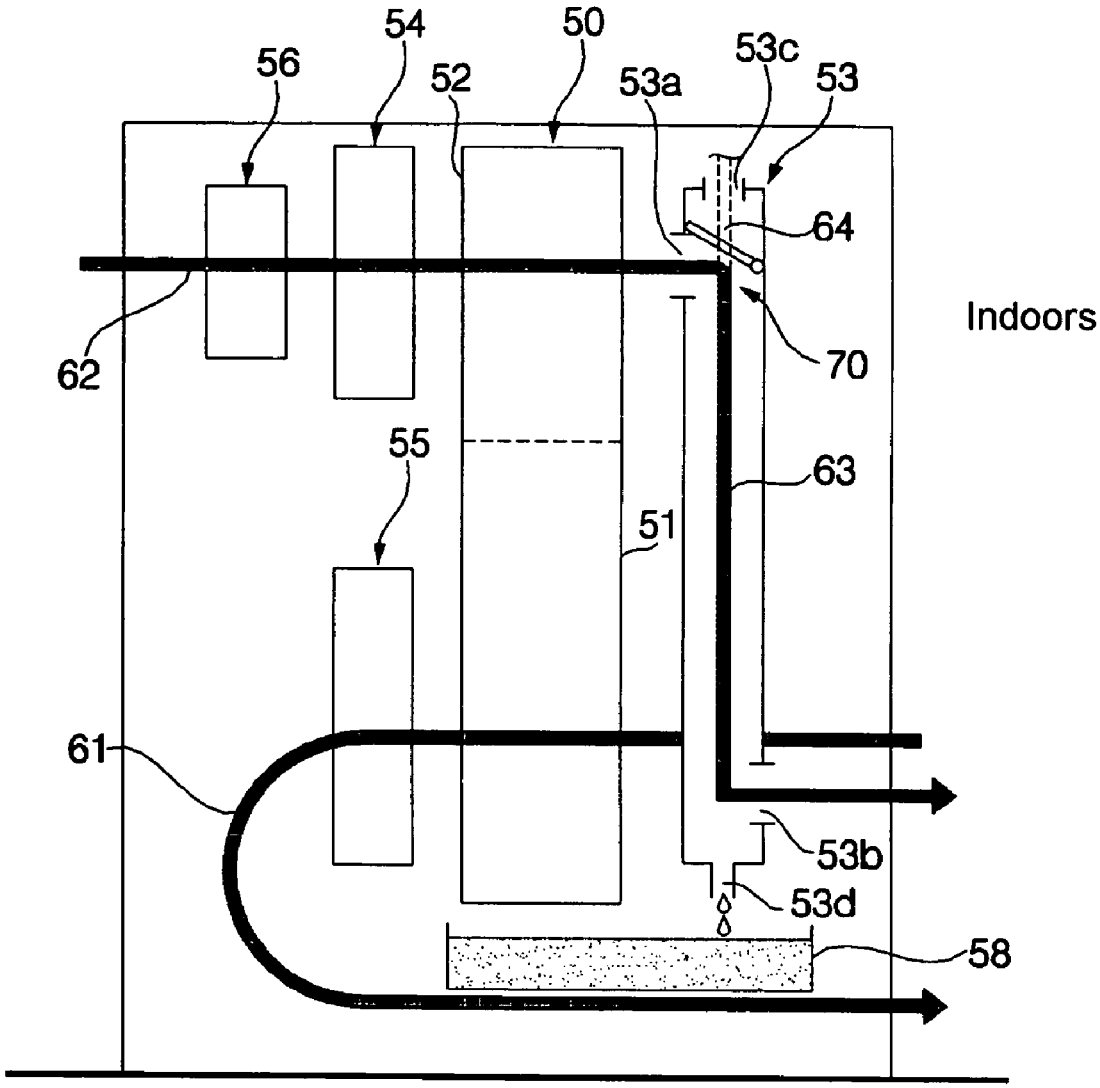
FIG. 3 is a schematic view of the air conditioner, illustrating a state in which the air conditioner operates in dehumidification mode.

FIG. 2 is a schematic view of an air conditioner according to an exemplary embodiment of the present invention, illustrating a state in which the air conditioner operates in humidification mode. FIG. 3 is a schematic view of the air conditioner, illustrating a state in which the air conditioner operates in dehumidification mode.

As shown in FIGS. 2 and 3, the air conditioner according to the illustrated embodiment of the present invention includes a desiccant wheel 50 divided into a moisture absorption portion 51 which absorbs moisture from air, and a moisture release portion 52 which releases moisture to air, a first flow path 61 which extends through the moisture absorption portion 51, to enable indoor or outdoor air passing through the first flow path 61 to be dehumidified by the moisture absorption portion 51, and a second flow path 62 which extends through the moisture release portion 52, to enable indoor air passing through the second flow path 62 to be humidified by the moisture release portion 52. The air conditioner also includes a heat exchanger 53 which heat-exchanges the air passing through the first flow path 61 with the air humidified in the second flow path 62, to condense moisture contained in the humidified air, and a third flow path 63 branched from the second flow path 62, to guide the air humidified in the second flow path 62 to be discharged into the room after passing through the heat exchanger 53. The air conditioner further includes a fourth flow path 64 branched from the second flow path 62, to guide the air humidified in the second flow path 62 to be directly discharged into the room, and a path selector adapted to select one of the third and fourth flow paths 63 and 64, through which the air humidified in the second flow path 62 will pass.

The air conditioner further includes a heater 54 arranged in the second flow path 62, to heat air which will pass through the moisture release portion 52.

A rotator is connected to the desiccant wheel 50, so as to turn the desiccant wheel 50 such that the positions of the moisture absorption portion 51 and moisture release portion 52 are reversed.

For the rotator (not shown), a motor may be used which includes a rotating shaft axially coupled to a rotation center of the desiccant wheel 50. Alternatively, a motor may be used which is connected to the desiccant wheel 50 via a belt wound around the desiccant wheel 50.

A first blowing fan 55 is arranged in the first flow path 61, to force indoor air or outdoor air to flow along the first flow path 61. A second blowing fan 56 is arranged in the second flow path 62, to force indoor air to flow along the second flow path 62.

The first flow path 61 has opposite ends which are connected to outdoor ducts 57 in the humidification mode of the air conditioner, to guide outdoor air to the room, and are separated from the outdoor ducts in the dehumidification mode of the air conditioner, to suck indoor air and to discharge the sucked indoor air.

The second flow path 62 has one end communicating with the room, and the other end, at which the third flow path 63 and fourth flow path 64 are branched from the second flow path 62.

The branching of the third and fourth flow paths 63 and 64 from the other end of the second flow path 62 may be achieved inside or outside the heat exchanger 53. The following description will be given only in conjunction with the case in which the branching of the third and fourth flow paths 63 and 64 from the other end of the second flow path 62 is achieved inside the heat exchanger 53.

The heat exchanger 53 has an inlet 73 which communicates with the other end of the second flow path 62, a first outlet 71 which communicates with the third flow path 63, to discharge air heat-exchanged in the heat exchanger 53 into the room, and a second outlet 72 which communicates with the fourth flow path 64, to discharge air emerging from the second flow path 62 into the room.

In order to enable the air introduced into the heat exchanger 53 through the inlet 73 to be sufficiently heat-exchanged while passing through the heat exchanger 53, it is preferred that the inlet 73 and second outlet 72 be arranged at an upper portion of the heat exchanger 53, and that the first outlet 71 be arranged at a lower portion of the heat exchanger 53.

A condensed water outlet 74 is formed at the bottom of the heat exchanger 53, to outwardly discharge condensed water produced in the heat exchanger 53. A drain pan is arranged beneath the heat exchanger, to collect the condensed water discharged from the condensed water outlet 74.

It is preferred that the drain pan 58 be detachably mounted in the heat exchanger 53 such that the drain pan 58 is removable from the heat exchanger 53 in the humidification mode.

The path selector is mounted in the heat exchanger 53, to selectively open/close the third and fourth flow paths 63 and 64, thereby allowing the air humidified in the second flow path 62 to be introduced into the fourth flow path 64 in the humidification mode of the air conditioner and to be introduced into the third flow path 63 in the dehumidification mode.

That is, the path selector opens the fourth flow path 64 while closing the third flow path 63 in the humidification mode. In the dehumidification mode, the path selector closes the fourth flow path 64 while opening the third flow path 63.

For the path selector, accordingly, a damper 80 or a 3-way valve may be used which selectively opens at least one of the third and fourth flow paths 63 and 64. The following description will be given only in conjunction with the case in which the damper 80 is used.

The damper 80 includes a baffle hingably mounted in the heat exchanger 53, and a baffle motor (not shown) adapted to hinge the baffle.

The air conditioner further includes an operating panel (not shown) which enables the user to select one of the dehumidification mode and humidification mode, and a controller which controls the damper 80, the first and second blowing fans 55 and 56, the motor (not shown), the heater 54, etc., in accordance with operation of the operating panel.

Hereinafter, operation of the air conditioner having the above-described configuration according to the illustrated embodiment of the present invention will be described.

When it is desired to operate the air conditioner in the humidification mode, the user connects both ends of the first flow path 61 to respective outdoor ducts 57, as shown in FIG. 2, and operates the operating panel (not shown) to input a humidification mode selection signal. In response to the humidification mode selection signal, the controller controls the damper 80 to open the fourth flow path 64 and to close the third flow path 63.

In this case, accordingly, outdoor air is introduced into the first flow path 61. The introduced outdoor air then releases moisture to the moisture absorption portion 51 while passing through the moisture absorption portion 51 of the desiccant wheel 50, so that the air is dehumidified. The dehumidified air is then discharged to the outdoors via the discharge-side outdoor duct 57.

Meanwhile, indoor air is introduced into the second flow path 62. The introduced indoor air is then heated to high temperature by the heater 54 while passing through the heater 54.

The heated air absorbs moisture from the moisture release portion 52 of the desiccant wheel 50 while drying the moisture release portion 52 as the heated air passes through the moisture release portion 52, so that the air is humidified.

The humidified air is introduced the fourth flow path 64 opened by the damper 80, and is then discharged to the room through the second outlet 72 of the heat exchanger 53.

Although the humidified air is also introduced into the interior of the heat exchanger 53 through the inlet 73 in this case, the introduced humidified air cannot heat-exchange with the air passing through the first flow path 61 because the first flow path 61 extends through the lower portion of the heat exchanger 53.

Accordingly, the humidified air is directly discharged to the room. Thus, the room is humidified.

Thus, when the air conditioner operates in the humidification mode, the humidified air is directly discharged to the room without being heat-exchanged in the heat exchanger 53, so that no condensed water is produced in the heat exchanger 53. In this case, accordingly, it is unnecessary to use the drain pan 58.

On the other hand, when it is desired to operate the air conditioner in the dehumidification mode, the user separates both ends of the first flow path 61 from respective outdoor ducts 57, and mounts the drain pan 58 in the air conditioner beneath the heat exchanger 53, as shown in FIG. 3.

The user subsequently operates the operating panel (not shown) to input a dehumidification mode selection signal. In response to the dehumidification mode selection signal, the controller controls the damper 80 to open the third flow path 63 and to close the fourth flow path 64.

In this case, indoor air is introduced into the first flow path 61. The introduced indoor air releases moisture to the moisture absorption portion 51 of the desiccant wheel 50, so that the air is dehumidified. The dehumidified air is then re-discharged to the room.

Thus, the room is dehumidified by the dehumidified air introduced into the room.

Meanwhile, the indoor air is also introduced into the second flow path 62. The indoor air introduced into the second flow path 62 is then heated to high temperature by the heater 54 while passing through the heater 54.

The heated air absorbs moisture from the moisture release portion 52 of the desiccant wheel 50 while drying the moisture release portion 52 as the heated air passes through the moisture release portion 52, so that the air is humidified.

The humidified air is introduced into the third flow path 63 opened by the damper 80, and is then heat-exchanged with the air passing through the first flow path 61 around the heat exchanger 53.

Since the air passing through the third flow path 63 is hot and humid, and the air passing through the first flow path 61 is colder than the air passing through the third flow path 63, the air passing through the third flow path 63 is subjected to condensation in the heat exchanger 53.

As moisture contained in the air passing through the third flow path 63 is condensed in the heat exchanger 53, the air passing through the third flow path 63 releases moisture therefrom. Condensed water produced in the heat exchanger 53 is discharged to the drain pan 58 through the condensed water outlet 74 of the heat exchanger 53.

The moisture-released air is then re-discharged to the room through the first outlet 71. Thus, the room is dehumidified.

As apparent from the above description, when the air conditioner operates in the dehumidification mode, the first flow path 61 is separable from the outdoor ducts 57 because only the indoor air is used. In this case, accordingly, the air conditioner can be installed at any place in the room.

Although the heater 54 has been described as being arranged in the second flow path 62 between the second blowing fan 56 and the desiccant wheel 50 in the illustrated embodiment, the present invention is not limited thereto. In accordance with the present invention, the second blowing fan 56 may be arranged between the heater 54 and the desiccant wheel 50.

Also, although the first and second blowing fans 55 and 56 have been described as being arranged in the first and second flow paths 61 and 62, respectively, in the illustrated embodiment, the present invention is not limited thereto. In accordance with the present invention, one common blowing fan (not shown) may be used to force air to flow along both the first and second flow paths 61 and 62.

As apparent from the above description, the air conditioner according to the present invention has various effects.

Namely, since the air conditioner according to the present invention includes the path selector to select a desired flow path of air humidified in the moisture release portion of the desiccant wheel in accordance with the humidification mode or dehumidification mode, the air conditioner can be usable as either a humidifier or a dehumidifier, in accordance with a user selection.

Also, since only indoor air is used when the air conditioner operates in the dehumidification mode, the first flow path is separable from the outdoor ducts. In this case, accordingly, there is an advantage in that the air conditioner can be installed in any place in the room.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. An air conditioner comprising:

a desiccant wheel divided into a moisture absorption portion which absorbs moisture from air, and a moisture release portion which releases moisture to air;

a first flow path which extends through the moisture absorption portion, to enable indoor or outdoor air passing through the first flow path to be dehumidified by the moisture absorption portion;

a second flow path which extends through the moisture release portion, to enable indoor air passing through the second flow path to be humidified by the moisture release portion;

a heat exchanger which heat-exchanges the air passing through the first flow path with the air humidified in the second flow path;

a third flow path branched from the second flow path, to guide the air humidified in the second flow path to be discharged into a room after passing through the heat exchanger in a dehumidification mode;

a fourth flow path branched from the second flow path, to guide the air humidified in the second flow path to be directly discharged into the room in a humidification mode; and a path selector adapted to select one of the third flow path and the fourth flow path, through which the air humidified in the second flow path will pass, when an associated one of the humidification mode and the dehumidification mode is selected.

2. The air conditioner according to claim 1, wherein the path selector is arranged at a region where the third flow path and the fourth flow path are branched from the second flow path.

3. The air conditioner according to claim 1, wherein the path selector comprises a damper adapted to selectively open one of the third flow path and the fourth flow path.

4. The air conditioner according to claim 1, wherein the path selector comprises a 3-way valve adapted to selectively open one of the third flow path and the fourth flow path.

5. The air conditioner according to claim 1, further comprising:

an operating panel which enables a user to select one of the dehumidification mode and the humidification mode; and a controller which controls the path selector in accordance with an operation of the operating panel.

6. The air conditioner according to claim 1, further comprising:

a heater arranged in the second flow path, to heat the air passing through the moisture releasing portion.

7. The air conditioner according to claim 1, further comprising:

a drain pan adapted to collect condensed water discharged from the heat exchanger.

8. The air conditioner according to claim 7, wherein the drain pan is detachably mounted in the air conditioner beneath the heat exchanger.

9. The air conditioner according to claim 1, wherein the first flow path is connected to an outdoor duct which guides outdoor air into the room, in the humidification mode.

10. The air conditioner according to claim 1, further comprising:

a first blowing fan arranged in the first flow path, to force the indoor air or outdoor air to flow along the first flow path; and a second blowing fan arranged in the second flow path, to force the indoor air to flow along the second flow path.

11. An air conditioner comprising:

a desiccant wheel divided into a moisture absorption portion which absorbs moisture from air, and a moisture release portion which releases moisture to air;

a first flow path which extends through the moisture absorption portion, to enable indoor or outdoor air passing through the first flow path to be dehumidified by the moisture absorption portion;

a second flow path which extends through the moisture release portion, to enable indoor air passing through the second flow path to be humidified by the moisture release portion;

a heat exchanger which heat-exchanges the air passing through the first flow path with the air humidified in the second flow path;

a third flow path branched from the second flow path, to guide the air humidified in the second flow path to be discharged into a room after passing through the heat exchanger in a dehumidification mode;

a fourth flow path branched from the second flow path, to guide the air humidified in the second flow path to be directly discharged into the room in a humidification mode; and a path selector adapted to select one of the third flow path and the fourth flow path, through which the air humidified in the second flow path will pass, when an associated one of the humidification mode and the dehumidification mode is selected, wherein the branching of the third and fourth flow paths from the second flow path is achieved inside the heat exchanger.

12. The air conditioner according to claim 11, wherein the heat exchanger has an inlet which communicates with the second flow path, a first outlet which communicates with the third flow path, and a second outlet which communicates with the fourth flow path.

13. The air conditioner according to claim 11, wherein the path selector is arranged at a region where the third flow path and the fourth flow path are branched from the second flow path.

14. The air conditioner according to claim 11, wherein the path selector comprises a damper adapted to selectively open one of the third flow path and the fourth flow path.

15. The air conditioner according to claim 11, wherein the path selector comprises a 3-way valve adapted to selectively open one of the third flow path and the fourth flow path.

16. The air conditioner according to claim 11, further comprising:

an operating panel which enables a user to select one of the dehumidification mode and the humidification mode; and a controller which controls the path selector in accordance with an operation of the operating panel.

17. The air conditioner according to claim 11, further comprising:

a heater arranged in the second flow path, to heat the air passing through the moisture releasing portion.

18. The air conditioner according to claim 11, further comprising:

a drain pan adapted to collect condensed water discharged from the heat exchanger.

19. The air conditioner according to claim 18, wherein the drain pan is detachably mounted in the air conditioner beneath the heat exchanger.

20. The air conditioner according to claim 11, wherein the first flow path is connected to an outdoor duct which guides outdoor air into the room, in the humidification mode.

* * * * *